US009455533B1

(12) United States Patent
Evans et al.

(10) Patent No.: US 9,455,533 B1
(45) Date of Patent: Sep. 27, 2016

(54) ELECTRICAL CONNECTOR HAVING WAFER SUB-ASSEMBLIES

(71) Applicant: Tyco Electronics Corporation, Berwyn, PA (US)

(72) Inventors: Nicholas Lee Evans, Harrisburg, PA (US); Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/739,530

(22) Filed: Jun. 15, 2015

(51) Int. Cl.
*H01R 13/648* (2006.01)
*H01R 13/6581* (2011.01)
*H01R 12/70* (2011.01)

(52) U.S. Cl.
CPC ..... *H01R 13/6581* (2013.01); *H01R 12/7076* (2013.01)

(58) Field of Classification Search
CPC ..... H01R 13/658; H01R 13/504; H01R 13/6581; H01R 13/6593
USPC ..... 439/670.1, 670.05, 670.07, 670.09, 439/670.11, 701
See application file for complete search history.

(56) References Cited

U.S. PATENT DOCUMENTS

| | | | | |
|---|---|---|---|---|
| 7,621,779 | B2 * | 11/2009 | Laurx et al. | H01R 13/514 439/607.07 |
| 8,475,209 | B1 * | 7/2013 | Whiteman, Jr. et al. | H01R 12/724 439/607.07 |
| 8,905,786 | B2 * | 12/2014 | Davis et al. | H01R 13/6587 439/108 |
| 8,961,229 | B2 * | 2/2015 | Pan | H01R 13/6474 439/607.07 |
| 2002/0098727 | A1 * | 7/2002 | McNamara et al. | H01R 23/688 439/108 |
| 2002/0168898 | A1 * | 11/2002 | Billman et al. | H01R 13/514 439/607.07 |
| 2007/0207641 | A1 * | 9/2007 | Minich | H01R 23/688 439/79 |
| 2012/0214343 | A1 * | 8/2012 | Buck et al. | H01R 13/6586 439/607.05 |

* cited by examiner

*Primary Examiner* — Abdullah Riyami
*Assistant Examiner* — Thang Nguyen

(57) ABSTRACT

An electrical connector includes a plurality of contact modules stacked parallel to each other within a housing. Each contact module includes a pair of wafer sub-assemblies. The wafer sub-assemblies are identical and oriented 180° with respect to each other. Each wafer sub-assembly includes an overmolded leadframe and a conductive shell holding the overmolded leadframe. The overmolded leadframe has a plurality of contacts including intermediate sections extending between mating and mounting ends. The intermediate sections are encased in an overmolded body of the overmolded leadframe. The shell has a pocket at an inner side thereof receiving the overmolded leadframe and the inner sides of the shells face each other. The shell has securing features for securing the shells together and the shell provides electrical shielding for the contacts of the overmolded leadframe.

20 Claims, 5 Drawing Sheets

ELECTRICAL CONNECTOR HAVING WAFER SUB-ASSEMBLIES

BACKGROUND OF THE INVENTION

The subject matter herein relates generally to electrical connectors having stacked contact modules.

Some electrical systems, such as backplane systems, utilize electrical connectors to interconnect two circuit boards, such as a motherboard and daughtercard. In typical backplane systems, the circuit boards are oriented perpendicular and the electrical connectors are right angle electrical connectors that transition between the perpendicular circuit boards. Some applications require electrical connections mid-board, such electrical connections being achieved using vertical or mezzanine electrical connectors between parallel circuit boards. However, as speed and performance demands increase, known electrical connectors are proving to be insufficient. Signal loss and/or signal degradation is a problem in known electrical systems. Additionally, there is a desire for reduced part or component count, to reduce manufacturing costs.

A need remains for an electrical connector with a low component count that provides efficient shielding to meet particular performance demands.

BRIEF DESCRIPTION OF THE INVENTION

In one embodiment, an electrical connector is provided including a plurality of contact modules stacked parallel to each other within a housing. Each contact module includes a pair of wafer sub-assemblies. The wafer sub-assemblies are identical and oriented 180° with respect to each other. Each wafer sub-assembly includes an overmolded leadframe and a conductive shell holding the overmolded leadframe. The overmolded leadframe has a plurality of contacts including intermediate sections extending between mating ends and mounting ends. The intermediate sections are encased in an overmolded body of the overmolded leadframe. The shell has an inner side defining a pocket. The overmolded leadframe is disposed in the pocket. The inner side of the shell of one wafer sub-assembly facing the inner side of the shell of the other wafer sub-assembly. The shell of one wafer sub-assembly is secured to the shell of the other wafer sub-assembly. The shell provides electrical shielding for the contacts of the overmolded leadframe.

In another embodiment, an electrical connector is provided including a plurality of contact modules stacked parallel to each other within a housing. The housing and contact modules are configured to be mated with a mating connector at a mating end of the housing. The contact modules are configured to be mounted to a circuit board opposite the mating end. Each contact module includes a pair of wafer sub-assemblies that are identical and oriented 180° with respect to each other. Each wafer sub-assembly includes an overmolded leadframe and a conductive shell holding the overmolded leadframe. The overmolded leadframe has a plurality of contacts including intermediate sections extending between mating ends and mounting ends. The mating ends are provided at the mating end of the housing for mating with the mating connector. The mounting ends are opposite the mating ends. The intermediate sections are oriented generally linearly between the mating and mounting ends and are encased in an overmolded body of the overmolded leadframe. The shell has a pocket at an inner side thereof receiving the overmolded leadframe. The inner side of the shell of one wafer sub-assembly faces the inner side of the shell of the other wafer sub-assembly. The shell of one wafer sub-assembly is secured to the shell of the other wafer sub-assembly. The shell provides electrical shielding for the contacts of the overmolded leadframe.

In a further embodiment, an electrical connector is provided including a plurality of contact modules stacked parallel to each other within a housing. The housing and contact modules are configured to be mated with a mating connector at a mating end of the housing. Each contact module includes a first wafer sub-assembly and a second wafer sub-assembly. Each contact module includes a first shield coupled to the first wafer sub-assembly and a second shield coupled to the second wafer sub-assembly. The first and second wafer sub-assemblies are identical and oriented 180° with respect to each other. The first and second wafer sub-assemblies each include an overmolded leadframe and a conductive shell holding the overmolded leadframe and providing electrical shielding for the overmolded leadframe. The overmolded leadframe has a plurality of contacts including intermediate sections extending between mating ends and mounting ends. The intermediate sections are encased in an overmolded body of the overmolded leadframe. The first and second shields are coupled to the shells of the first and second wafer sub-assemblies. The first and second shields each include a main body with ground beams extending therefrom for mating with the mating connector.

DETAILED DESCRIPTION OF THE INVENTION

Figure 1:
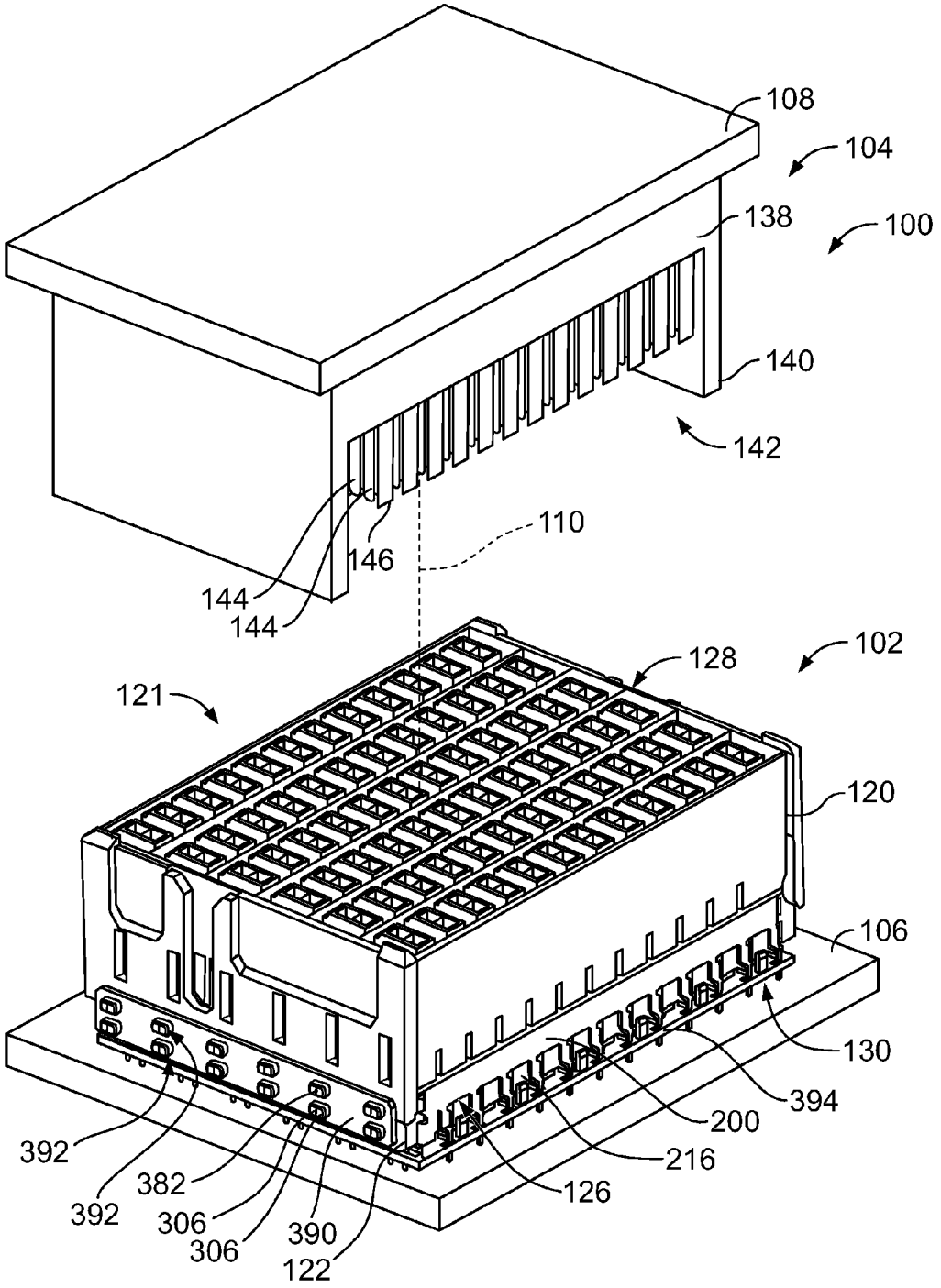
FIG. 1 is a perspective view of an exemplary embodiment of an electrical connector system illustrating a receptacle assembly and a header assembly that may be directly mated together.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as an "electrical connector" or collectively as "electrical connectors" or may be referred to hereinafter individually as a "mating connector" or collectively as "mating connectors". In the illustrated embodiment, the receptacle and header assemblies 102, 104 are each electrically connected to respective circuit boards 106, 108; however either or both of the electrical connectors 102, 104 may be cable connectors provided at ends of corresponding cables.

A mating axis 110 extends through the receptacle and header assemblies 102, 104. The receptacle and header assemblies 102, 104 are mated together in a direction parallel to and along the mating axis 110. The receptacle and header assemblies 102, 104 are utilized to electrically connect the circuit boards 106, 108 to one another at a separable mating interface. In an exemplary embodiment, the circuit boards 106, 108 are oriented parallel to one another when the receptacle and header assemblies 102, 104 are mated. As such, the electrical connectors 102, 104 define mezzanine connectors. Alternative orientations of the circuit boards 106, 108 are possible in alternative embodiments.

The receptacle assembly 102 includes a housing 120 at a front 121 of the receptacle assembly 102 that holds a plurality of contact modules 122. The contact modules 122 are stacked side-by-side parallel to each other within the housing 120, and may extend rearward from the housing 120. Any number of contact modules 122 may be provided to increase the number of data channels between the circuit boards 106, 108. The contact modules 122 each include a plurality of receptacle signal contacts 124 (shown in FIG. 2), or simply contacts 124, that are received in the housing 120 for mating with the header assembly 104.

In an exemplary embodiment, each contact module 122 has a shield structure 126 for providing electrical shielding for the contacts 124. In an exemplary embodiment, the shield structure 126 is electrically connected to the header assembly 104 and/or the circuit board 106. For example, the shield structure 126 may be electrically connected to the header assembly 104 by grounding members (e.g. beams or fingers) extending from the contact modules 122 that engage the header assembly 104. For example, the shield structures 126 of the contact modules 122 are electrically connected with header shields 146 of the header assembly 104 to electrically common the receptacle and header assemblies 102, 104. The shield structure 126 may be electrically connected to the circuit board 106 by features, such as ground pins. The shield structure 126 may provide shielding along substantially the entire length of the data channels between the circuit boards 106, 108.

The receptacle assembly 102 includes a mating end 128 and a mounting end 130. The contacts 124 are received in the housing 120 and held therein at the mating end 128 for mating to the header assembly 104. The contacts 124 are arranged in a matrix of rows and columns. Any number of contacts 124 may be provided in the rows and columns. The contacts 124 may be arranged in pairs configured to carry differential signals. The contacts 124 also extend to the mounting end 130 for mounting to the circuit board 106. Optionally, the mounting end 130 may be substantially parallel to and opposite the mating end 128. Other arrangements are possible in alternative embodiments, such as a perpendicular arrangement.

The header assembly 104 includes a header housing 138 having walls 140 defining a chamber 142. The receptacle assembly 102 is received in the chamber 142 when mated thereto. The header assembly 104 includes header signal contacts 144 and the header shields 146 that surround and shield corresponding header signal contacts 144. In an exemplary embodiment, the header signal contacts 144 are arranged as differential pairs. The header shields 146 are positioned between the differential pairs to provide electrical shielding between adjacent differential pairs. In the illustrated embodiment, the header shields 146 are C-shaped and provide shielding on three sides of the corresponding pair of header signal contacts 144. The header shields 146 may have other shapes in alternative embodiments.

Figure 2:
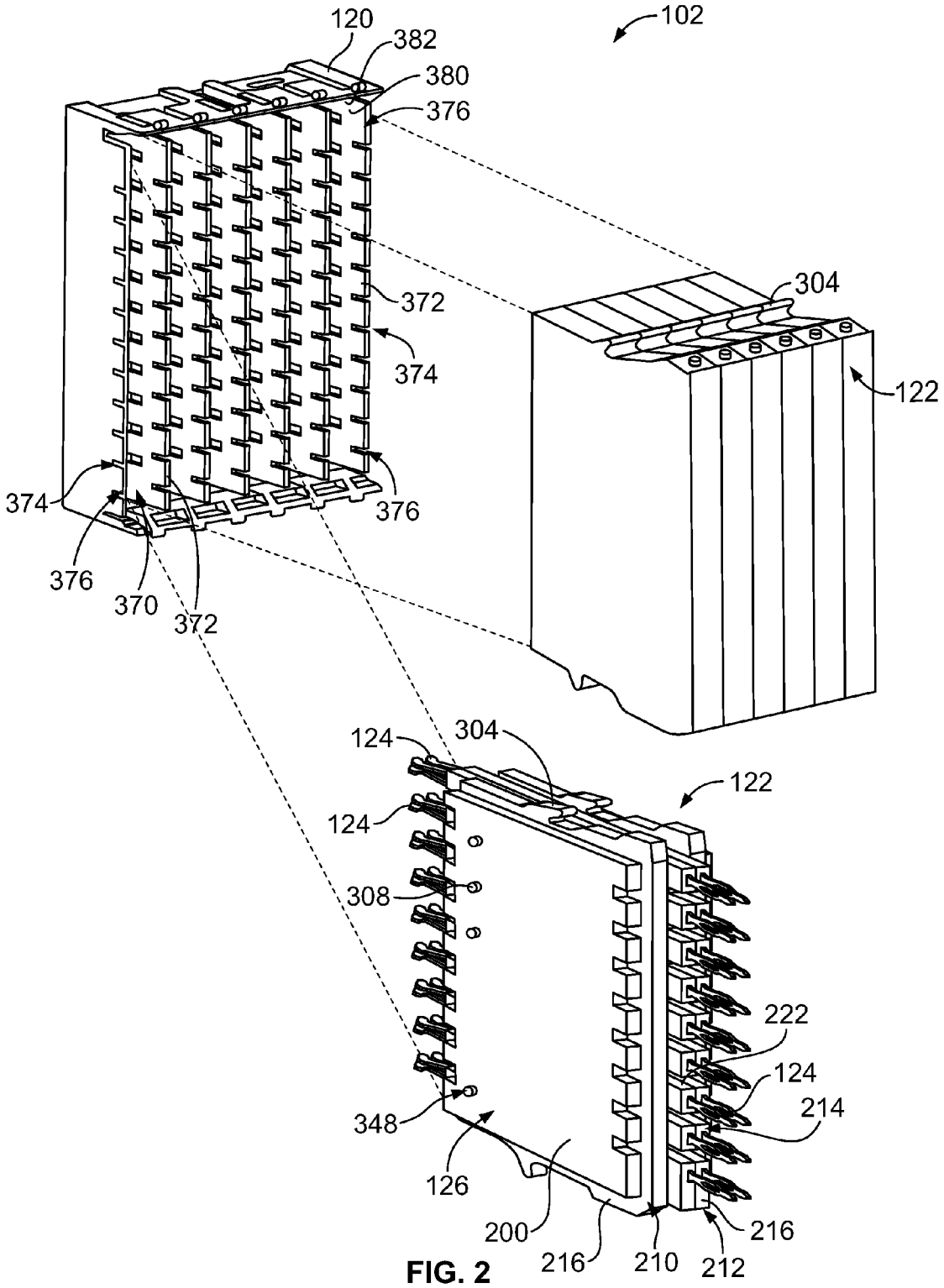
FIG. 2 is an exploded view of one of the receptacle assembly showing contact modules thereof.

FIG. 2 is an exploded view of the receptacle assembly 102 showing the contact modules 122 poised for loading into the housing 120. One of the contact modules 122 is partially exploded to illustrate various components thereof. The shield structure 126 includes a first ground shield 200 and a second ground shield 202 (shown in FIG. 8). The first and second ground shields 200, 202 electrically connect the contact module 122 to the header shields 146 (shown in FIG. 1). The first and second ground shields 200, 202 provide multiple, redundant points of contact to the header shield 146. The first and second ground shields 200, 202 provide shielding on all sides of the contacts 124.

The contact module 122 includes a pair of wafer sub-assemblies identified as a first wafer sub-assembly 210 and a second wafer sub-assembly 212. Each wafer sub-assembly 210, 212 includes an overmolded leadframe 214 and a conductive shell 216. The overmolded leadframe 214 includes a leadframe 220 (shown in FIG. 3), including the contacts 124, that is held in an overmolded body 222. The overmolded leadframe 214 is held in the conductive shell 216. The conductive shell 216 provides shielding for the overmolded leadframe 214. The first and second ground shields 200, 202 are configured to be coupled to the first and second wafer sub-assemblies 210, 212, respectively, such as to the shells 216.

In an exemplary embodiment, the wafer sub-assemblies 210, 212 are identical and oriented 180° with respect to each other. As such, the cost of manufacture of the wafer sub-assemblies 210, 212 is reduced as fewer dies or molds are needed. Additionally, the component or part count is reduced making storage of the parts less expensive. In an exemplary embodiment, while the first and second ground shields 200, 202 are similar and include similar features, the first and second ground shields 200, 202 are not identical. Optionally, the ground shields 200, 202 may be mirrored with respect to each other on opposite sides of the wafer sub-assemblies 210, 212.

Figure 3:
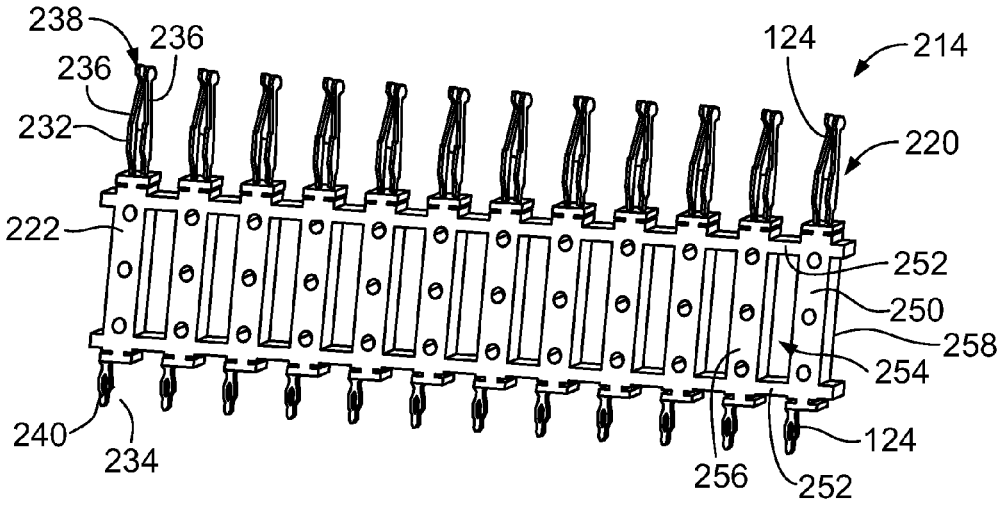
FIG. 3 is a perspective view of an overmolded leadframe of the contact module in accordance with an exemplary embodiment.
Figure 4:
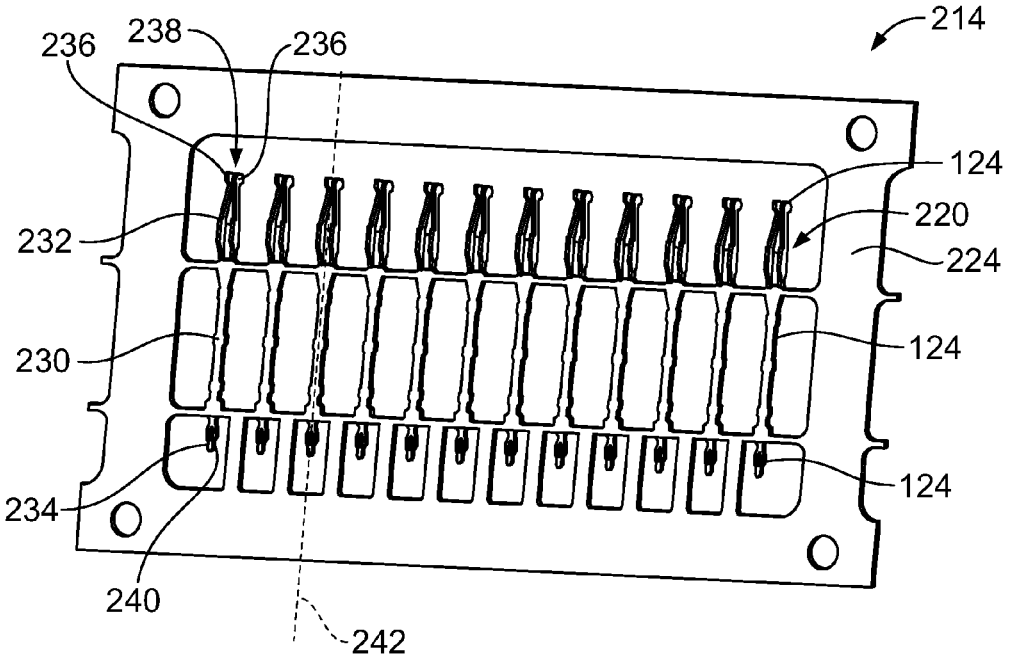
FIG. 4 is a perspective view of a portion of the overmolded leadframe.

FIG. 3 is a perspective view of the overmolded leadframe 214 in accordance with an exemplary embodiment. FIG. 4 is a perspective view of a portion of the overmolded leadframe 214 showing the leadframe 220 held by a carrier 224. The carrier 224 is removed after the overmolded body 222 (FIG. 3) is molded around the leadframe 220.

The leadframe 220 and the carrier 224 are stamped and formed from a common blank of sheet metal material. The leadframe 220 is stamped to form the contacts 124. The contacts 124 include intermediate sections 230 extending between mating ends 232 and mounting ends 234. The intermediate sections 230 are encased in the overmolded body 222 when the overmolded body 222 is molded over the leadframe 220. In an exemplary embodiment, the contacts 124 extend along parallel contact axes 242 between the mating and mounting ends 232, 234. For example, the intermediate sections 230 may extend along linear parallel paths. As such, the mating ends 232 are on opposite sides of the leadframe 220 from the mounting ends 234.

The mating ends 232 are configured to be mated with the header signal contacts 144 (shown in FIG. 1) of the header assembly 104 (shown in FIG. 1). In the illustrated embodiment, the mating ends 232 include opposed spring beams 236 that define a socket 238 configured to receive the corresponding header signal contact 144. The spring beams 236 are deflectable and configured to be biased against the header signal contact 144.

The mounting ends 234 are configured to be mounted to the circuit board 106 (shown in FIG. 1). The mounting ends 234 include compliant pins 240, such as eye-of-the-needle (EON) pins. Other types of contact interfaces may be provided at the mating ends 232 and/or mounting ends 234 in alternative embodiments.

The overmolded body 222 is manufactured from a dielectric material, such as a plastic material. The overmolded body 222 is molded over the leadframe 220 during a molding process. For example, the overmolding body 222 may be injection molded over the leadframe 220. The overmolded body 222 includes a plurality of frame members 250 each surrounding a corresponding intermediate section 230. Tie members 252 span between the frame members 250 and allow flow of the dielectric material between the frame members 250 during the molding process. The tie members 252 maintain a spacing between the frame members 250. Windows 254 are defined between the frame members 250. The windows 254 define an opening or space between adjacent contacts 124. The windows 254 are configured to receive portions of the shell 216 (shown in FIG. 2) when the overmolded leadframe 214 is received in the shell 216. As such, the shell 216 may provide shielding between adjacent contacts 124.

The overmolded body 222 includes an inner surface 256, which may be planar and configured to face the inner surface 256 of the other overmolded body 222 of the other wafer sub-assembly 210 or 212 when the contact module 122 is assembled. The overmolded body 222 includes an outer surface 258 opposite the inner surface 256. The outer surface 258 is configured to face and/or abut against the shell 216 when received therein.

In an exemplary embodiment, both the first and second wafer sub-assemblies 210, 212 use the same leadframe 220 and overmolded body 222. As such, the same stamping and forming dies may be used to form the leadframes 220 of both wafer sub-assemblies 210, 212. Additionally, the same mold or die may be used to form the overmolded bodies 222 of the wafer sub-assemblies 210, 212. Using the same stamps, dies, molds and the like reduces the manufacturing costs of the contact modules 122 (shown in FIG. 2). The inner surface 256 of the overmolded body 222 of the first wafer sub-assembly 210 faces the inner surface 256 of the overmolded body 222 of the second wafer sub-assembly 212 when the contact module 122 is assembled.

Figure 5:
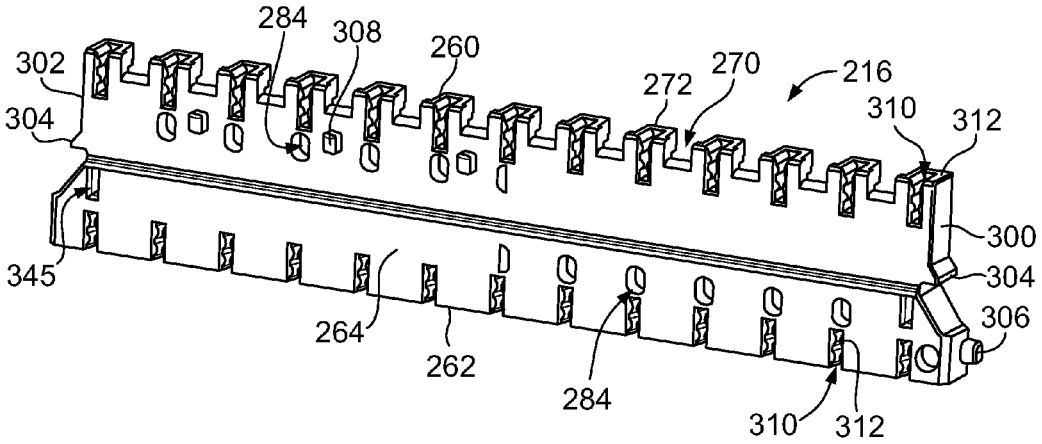
FIG. 5 is an exterior perspective view of a shell of the contact module in accordance with an exemplary embodiment.
Figure 6:
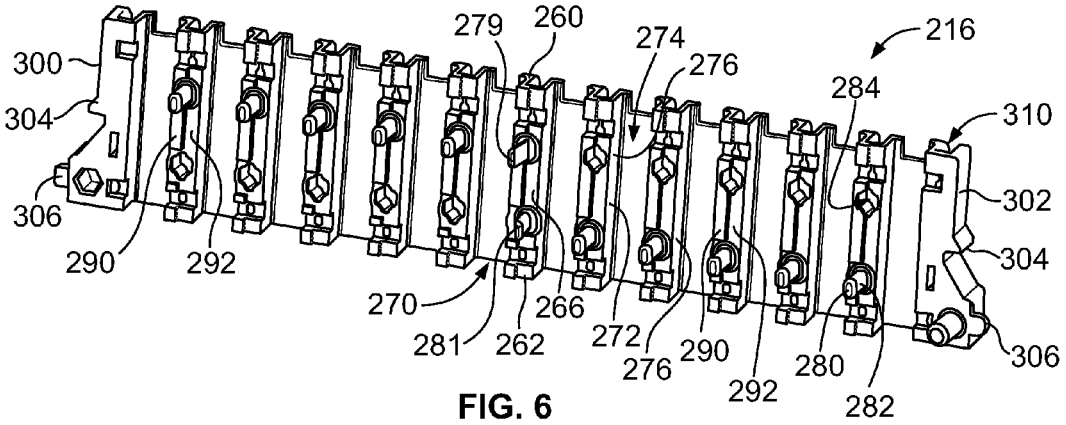
FIG. 6 is an interior perspective view of the shell in accordance with an exemplary embodiment.

FIG. 5 is an exterior perspective view of the shell 216 in accordance with an exemplary embodiment. FIG. 6 is an interior perspective view of the shell 216 in accordance with an exemplary embodiment. The shell 216 is conductive to provide electrical shielding for the overmolded leadframe 214 (shown in FIG. 2). For example, the shell 216 may be a die cast shell. The shell 216 may be a plated plastic shell. The shell 216 may be a conductive polymer shell. Other types of shells may be used in alternative embodiments. In other various embodiments, the shell 216 may be dielectric rather than conductive.

The shell 216 extends between a front 260 and a rear 262. The front 260 is configured to be loaded into the housing 120 (shown in FIG. 2). The rear 262 may be configured to be mounted to the circuit board 106 (shown in FIG. 1). The shell 216 has an outer side 264 (FIG. 5) and an inner side 266 (FIG. 6). In an exemplary embodiment, identical shells 216 are used in the first and second wafer sub-assemblies 210, 212 (shown in FIG. 2) to hold the overmolded leadframes 214 of the contact module 122. The shells 216 are coupled together during assembly of the contact module 122. The inner side 266 of the shell 216 of the first wafer sub-assembly 210 faces the inner side 266 of the shell 216 of the second wafer sub-assembly 212 when mated. Using identical shells 216 for both wafer sub-assemblies 210, 212 allows the use of a single mold or die to manufacture the shells, thereby reducing the manufacturing cost compared to a contact module that uses shells having two different structures and thus needing two different molds or dies. Various features are provided and positioned to allow the identical shells 216 to be coupled together, while providing mechanical and shielding integrity.

The inner side 266 of the shell 216 defines a pocket 270 that is configured to receive the overmolded leadframe 214. In an exemplary embodiment, the shell 216 includes a plurality of ribs 272 along the inner side 266 that divide the pocket 270 into a plurality of individual channels 274. Each channel 274 receives a corresponding frame member 250 (shown in FIG. 3) of the overmolded leadframe 214. The ribs 272 are configured to be received in corresponding windows 254 (shown in FIG. 3) between the frame members 250. The ribs 272 are thus configured to be positioned between adjacent contacts 124 (shown in FIG. 3) to provide shielding to such contacts 124.

In an exemplary embodiment, the ribs 272 include crush rib 276 along one or both sides thereof. The crush ribs 276 extend into the channels 274. The crush ribs 276 may be used to position and/or hold the overmolded body 222 in the pocket 270. Any number of crush ribs 276 may be provided. The crush ribs 276 may be located at other positions along the shell 216 in alternative embodiments.

The shell 216 includes a plurality of securing features 280 for securing the shell 216 of one wafer sub-assembly 210 to the shell 216 of the other wafer sub-assembly 212. In an exemplary embodiment, the securing features 280 include posts 282 extending from the inner side 266 and the securing features 280 include holes 284 formed in the ribs 272. The posts 282 of the shell 216 of one wafer sub-assembly 210 are configured to be received in the holes 284 of the shell 216 of the other wafer sub-assembly 212, and vice versa. The posts 282 are configured to be held in the holes 284 by an interference fit. For example, the posts 282 and/or the holes 284 may include crush ribs. Optionally, the holes 284 may be hexagonal and the posts 282 may be circular or oval in shape and configured to be received in the holes 284. The flat sides forming the hexagonal shaped holes 284 may engage and/or compress against the outer surface of the posts 282 to form an interference fit therebetween. In an exemplary embodiment, the posts 282 are conductive and configured to be electrically connected to the other shell 216 when received in the holes 284. Thus, the shells 216 may be electrically connected by the securing features 280.

The posts 282 and the holes 284 are arranged in a complementary pattern to allow the shells 216 to be mated together. For example, the pattern of posts 282 and holes 284 may be arranged such that, when one shell 216 is oriented 180° with respect to the other shell 216, the posts 282 of one shell 216 are aligned with the holes 284 of the other shell 216. One particular arrangement is illustrated in FIGS. 5 and 6, wherein when viewing the inner side 266, the ribs 272 on the left half of the shell 216 include posts 282 along an upper portion of such ribs 272 and holes 284 on lower portions of such ribs 272, whereas the ribs 272 on the right half of the shell 216 include holes 284 on the upper portion of such ribs 272 and posts 282 on the lower sections of such ribs 272. Optionally, at least one of the securing features 280 may include a post that is hemispherical and a hole that is hemispherical. For example, the middle rib 272 includes securing features 280 that are combined post/hole features.

For example, on the upper portion of the middle rib 272 is an upper half-post/half-hole feature 279 and on the lower section of the middle rib 272 is a lower half-post/half-hole feature 281. The half posts are arranged on respective opposite sides of the upper and lower half-post/half-hole features 279, 281. Each of the half-post/half-hole features 279, 281 is hermaphroditic so as to be matable with its counterpart half-post/half-hole feature 279, 281 on the mating shell 216. Other arrangements are possible in alternative embodiments. For example, each of the securing features may be half-post/half-hole features in alternative embodiments. In other various embodiments, different combinations of posts 282 and holes 284 may be provided on the ribs 272. Additionally, the ribs 272 may include greater or fewer securing features 280 per rib.

In an exemplary embodiment, the inner side 266 is non-planar. The inner side 266 includes a series of platforms 290 and a series of trenches 292 arranged in a complementary pattern to the ribs 272. The platforms 290 of the shell 216 of one wafer sub-assembly 210 are configured to be received in corresponding trenches 292 of the shell 216 of the other wafer sub-assembly 212 when the shells 216 are mated together. The platforms 290 and trenches 292 provide a stepped interface along the ribs 272 between the contacts 124 that are held in adjacent channels 274. By stepping the interface therebetween, EMI leakage between the channels 274 is reduced.

The shell 216 extends between a first end 300 and a second end 302. The shell 216 includes latches 304 at the first and second ends 300, 302. The latches 304 are used to secure the shell 216 in the housing 120 (shown in FIG. 2). In an exemplary embodiment, the shell 216 includes clip lugs 306 extending from the first and second ends 300, 302. The clip lugs 306 may be used to secure the shell 216 to the housing 120, such as using a bridge clip, as described in further detail below.

In an exemplary embodiment, the shell 216 includes a plurality of shell lugs 308 (shown in FIG. 5) extending from the outer side 264. Any number of shell lugs 308 may be provided. The shell lugs 308 may be located at any location along the outer side 264. In the illustrated embodiment, when viewing the outer side 264 (FIG. 5), the shell lugs 308 are located on the left side (e.g., closer to the second end 302) of the shell 216, whereas the right side does not include any shell lugs 308. Other arrangements are possible in alternative embodiments.

In an exemplary embodiment, the shell 216 includes a plurality of shield slots 310 along the outer side 264. The shield slots 310 may be located near both the front 260 and the rear 262. The shield slots 310 are configured to receive portions of the ground shields 200 or 202 (shown in FIGS. 7 and 8, respectively). The shield slots 310 include crush ribs 312 along both sides of the shield slots 310. The crush ribs 312 may be used to hold the ground shields 200, 202 in the shield slots 310 by an interference fit. The shield slots 310 may define points of electrical contact between the shell 216 and the ground shields 200, 202.

Figure 7:
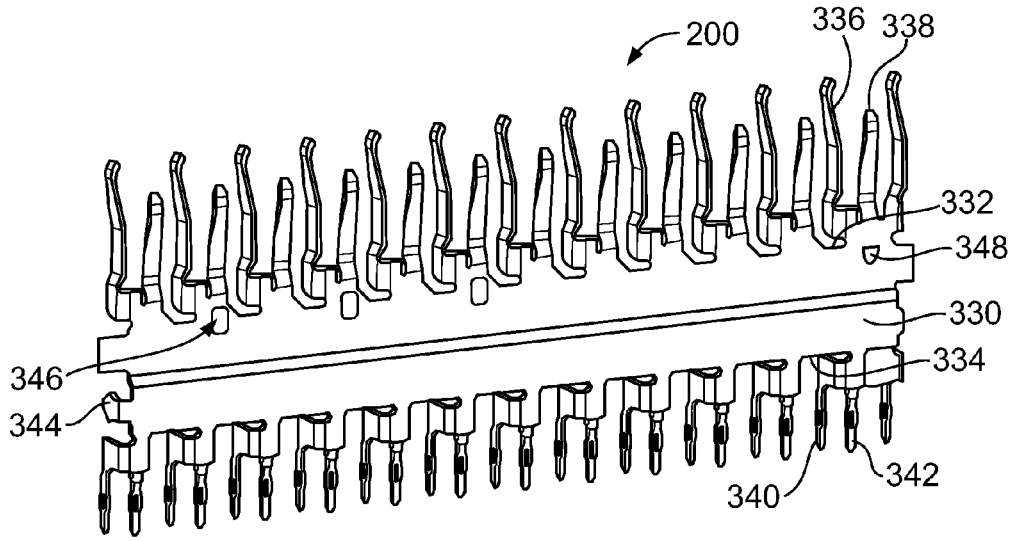
FIG. 7 is a front perspective view of a ground shield of the contact module formed in accordance with an exemplary embodiment.

FIG. 7 is a front perspective view of the first ground shield 200 formed in accordance with an exemplary embodiment. The second ground shield 202 (shown in FIG. 8) may include similar components and features as the first ground shield 200, such components being identified with the same reference numbers. The ground shield 200 includes a main body 330 extending between a front 332 and a rear 334. The ground shield 200 is stamped and formed from a blank of conductive material.

The ground shield 200 includes a plurality of ground beams 336, 338 extending from the front 332. The ground beams 336, 338 are stamped and formed with the main body 330. The ground beams 336, 338 are configured to be electrically connected to the corresponding header shield 146 (shown in FIG. 1) when mated to the header assembly 104 (shown in FIG. 1). The ground beams 336, 338 may be curved and are configured to be deflected when engaging the header shield 146. The ground beams 336 define interior ground beams that are configured to extend into the wafer sub-assembly 210 (shown in FIG. 2). The interior ground beams 336 are configured to be in line with the spring beams 236 (shown in FIG. 3). The ground beams 338 define exterior ground beams that are configured to extend along an exterior of the wafer sub-assembly 210. The interior ground beams 336 are bent, generally at a 90° angle relative to the main body 330 such that the interior ground beams 336 may be loaded into the corresponding shield slots 310 near the front 260 of the shell 216 (both shown in FIG. 5). The exterior ground beams 338 are generally in line with the main body 330.

The ground shield 200 includes a plurality of ground tails 340, 342 extending from the main body 330. The ground tails 340 are configured to be electrically connected to the circuit board 106. In the illustrated embodiment, the ground tails 340, 342 are compliant pins, such as EON pins; however, other types of ground tails may be provided in alternative embodiments, such as solder tails, spring beams, and the like. The ground tails 340 define interior ground tails configured to extend into the corresponding shield slots 310 near the rear 262 of the shell 216. The interior ground tails 340 are configured to be in line with the compliant pins 240 (shown in FIG. 3). The ground tails 342 define exterior ground tails configured to be arranged along the exterior of the wafer sub-assembly 210. The exterior ground tails 342 may be generally in line with the main body 330.

The ground shield 200 includes securing features 344 that are configured to secure the ground shield 200 to the corresponding shell 216. The securing features 344 may define barbs configured to be received in corresponding slots 345 (shown in FIG. 5) in the shell 216 and held therein by an interference fit. Other types of securing features may be used in alternative embodiments. Optionally, portions of the internal ground beams 336 and the internal ground tails 340 may engage the shell 216 to secure the ground shield 200 to the shell 216 by an interference fit.

The ground shield 200 includes a plurality of openings 346 in the main body 330. The openings 346 receive corresponding shell lugs 308 (FIG. 5). The shell lugs 308 may pass through the openings 346. The main body 330 includes a polarizing feature 348 extending therefrom. Optionally, the polarizing featuring 348 is offset to one side of the main body 330. The polarizing feature 348 may be used to ensure that the contact module 122 is loaded into the housing 120 in a proper orientation.

Figure 8:
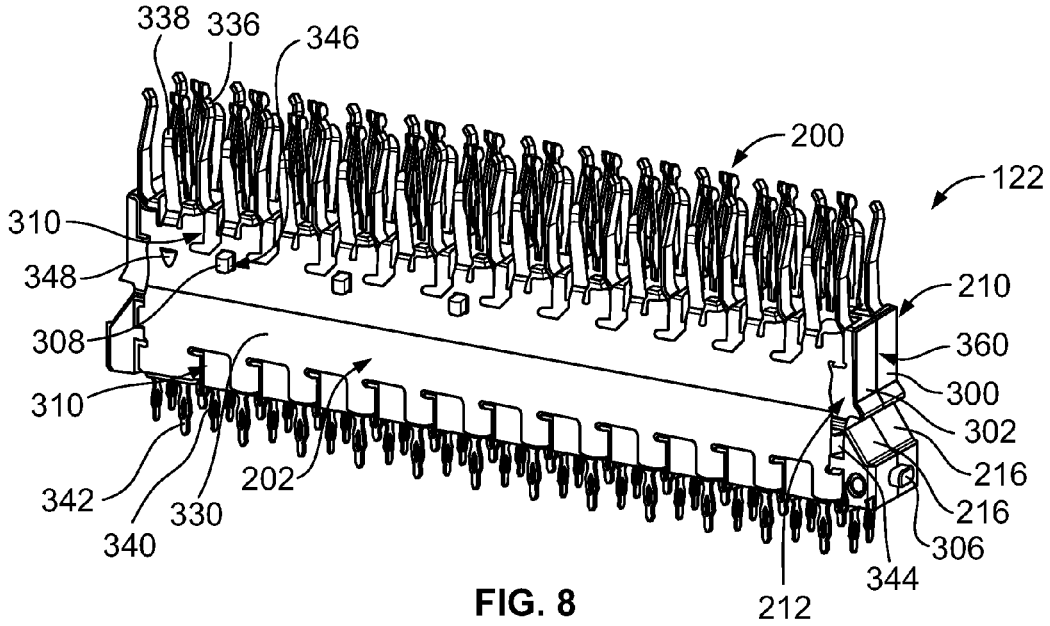
FIG. 8 is a perspective view of the contact module in an assembled state.

FIG. 8 is a perspective view of the contact module 122 in an assembled state. The second ground shield 202 is illustrated in FIG. 8. The second ground shield 202 is coupled to the second wafer sub-assembly 212. The second ground shield 202 is similar to the first ground shield 200 in that the second ground shield 202 includes a main body 330, ground beams 336, 338 and ground tails 340, 342. However, the polarizing feature 348 is provided at an opposite side of the main body 330 as compared to the first ground shield 200 (FIG. 7). Additionally, the interior ground beams 336 are located to the right of the corresponding exterior ground beams 338, as compared to the first ground shield 200 where the interior ground beam 336 are positioned to the left of the corresponding exterior ground beams 338 (see FIG. 7). Similarly, the interior ground tails 340 are located to the right of the corresponding exterior ground tails 342, as compared to the first ground shield 200 where the interior ground tails 340 are positioned to the left of the corresponding exterior ground tails 342 (see FIG. 7). Having the ground beams 336 and the ground nails 340 arranged as such allows the ground shield 200, 202 to be mirrored with respect to each other on opposite sides of the contact module 122.

During assembly of the contact module 122, the overmolded leadframes 214 (FIG. 4) are loaded into corresponding shells 216 to form the corresponding wafer sub-assemblies 210, 212. In an exemplary embodiment, the wafer sub-assemblies 210, 212 are identical. The second wafer sub-assembly 212 is oriented 180° with respect to the first wafer sub-assembly 210 and then the wafer sub-assemblies 210, 212 are mated together at an interface 360. The securing features 280 (shown in FIG. 6) are mated together to secure the shell 216 of the first wafer sub-assembly 210 to the shell 216 of the second wafer sub-assembly 210. The inner surfaces 256 (shown in FIG. 3) of the overmolded leadframes 214 of the first and second wafer sub-assemblies 210, 212 face each other on opposite sides of the interface 360. The first end 300 of the shell 216 of the first wafer sub-assembly 210 is aligned with the second end 302 of the shell 216 of the second wafer sub-assembly 210, and vice versa.

The ground shields 200, 202 are coupled to the wafer sub-assemblies 210, 212. The ground shields 200, 202 are secured using the securing features 344 and/or the interior ground beams 336 and/or the interior ground tails 340. For example, the ground beams 336 and ground tails 340 are received in the shield slots 310 and held therein by the crush ribs 312 (FIG. 5). The shell lugs 308 extend through corresponding openings 346 and are exposed beyond the ground shields 200, 202. The shell lugs 308 may be used to orient the contact module 122 within the housing 120 (shown in FIG. 1). In an exemplary embodiment, when the shells 216 are coupled together, the clip lugs 306 are positioned adjacent each other and form a common or single clip lug at both sides of the contact module 122.

Returning to FIG. 2, the contact modules 122 are aligned behind the housing 120 and configured to be loaded into corresponding channels 370 in the housing 120. The channels 370 are defined by dividing walls 372. The dividing walls 372 include slots 374. The contact modules 122 are aligned with the channels 370 such that the shell lugs 308 are aligned with corresponding slots 374. In an exemplary embodiment, the dividing walls 372 include polarizing features 376 that act with the polarizing features 348 of the ground shields 200, 202 to orient the contact module 122 with respect to the housing 120. The polarizing feature 348 may be aligned with a corresponding polarizing feature 376 in the housing 120 when the contact module 122 is properly oriented with respect to the housing 120. When the contact module 122 is improperly aligned with the housing 120 the polarizing feature 348 may block or restrict loading of the contact module 122 into the housing 120. For example, if the contact module 122 were to be inserted upside down into the housing 120, the polarizing feature 348 would prevent loading of the contact module 122 into the housing 120.

In an exemplary embodiment, the housing 120 includes latches 380 that interact with the latches 304 to secure the contact modules 122 in the housing 120. The housing 120 includes a plurality of clip lugs 382 extending from exterior surfaces of the housing 120.

Returning to FIG. 1, the electrical connector 102 includes a bridge clip 390 that spans from the housing 120 to each of the shells 216 of the contact modules 122. The bridge clip 390 includes a plurality of openings 392 receiving corresponding clip lugs 382, 306 of the housing 120 and the shells 216, respectively. Optionally, the bridge clip 390 may include securing features, such as latches, dimples, or other features that may engage the clip lugs 306, 382 to hold the bridge clip 390 thereon by an interference fit. Optionally, the bridge clip 390 may be used to transfer forces from the housing 120 to the contact modules 122. For example, when mounting the electrical connector 102 to the circuit board 106, an installer may press on the housing 120 in the direction of the circuit board 106. The pressing forces may be transferred from the housing 120 to each of the contact modules 122 by the bridge clip 390. Optionally, the shell lugs 308 (FIG. 2) may also bottom on the housing 120 and transmit seating force. By directly transferring the forces to the contact modules 122, the ground shields 200, 202 and contacts 124 may be more easily mounted to the circuit board 106. For example, the EON pins may be pressed into corresponding plated vias of the circuit board 106.

Optionally, the electrical connector 102 may include a pin spacer 394 between the contact modules 122 and the circuit board 106. The pin spacer 394 may include a plurality of pin openings that receive corresponding compliant pins 240 (shown in FIG. 3) and corresponding ground tails 340, 342 (shown in FIG. 7). The pin spacer 394 may hold such pins and/or tails in position for mating to the circuit board 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a plurality of contact modules stacked parallel to each other within a housing, each contact module comprising a pair of wafer sub-assemblies, the wafer sub-assemblies being identical and oriented 180° with respect to each other, each wafer sub-assembly comprising an overmolded leadframe and a conductive shell holding the overmolded leadframe;

the overmolded leadframe having a plurality of contacts including intermediate sections extending between mating ends and mounting ends, the intermediate sections being encased in an overmolded body of the overmolded leadframe; and the shell having an inner side defining a pocket, the overmolded leadframe being disposed in the pocket, the inner side of the shell of one wafer sub-assembly facing the inner side of the shell of the other wafer sub-assembly, the shell of one wafer sub-assembly being secured to the shell of the other wafer sub-assembly, the shell providing electrical shielding for the contacts of the overmolded leadframe.

2. The electrical connector of claim 1, wherein the shell includes ribs along the inner side, the ribs being positioned between adjacent contacts to provide electrical shielding between the contacts.

3. The electrical connector of claim 1, wherein the shell has hermaphroditic securing features that secure the shell of the one wafer sub-assembly to the shell of the other wafer sub-assembly.

4. The electrical connector of claim 1, wherein the contacts are oriented along parallel contact axes between the mating end and the mounting end.

5. The electrical connector of claim 1, wherein the overmolded body includes an outer surface facing the shell and an inner surface opposite the outer surface, the overmolded leadframe being arranged in the shell such that the inner surface of one wafer sub-assembly faces the inner surface of the other wafer sub-assembly.

6. The electrical connector of claim 1, wherein the securing features comprise posts extending from the inner side and the securing features comprise holes, the posts of one wafer sub-assembly being received in the holes of the other wafer sub-assembly and held therein by an interference fit.

7. The electrical connector of claim 6, wherein the posts and the holes are arranged in a complementary pattern to allow the shells to be mated together.

8. The electrical connector of claim 6, wherein at least one of the posts is hemi-spherical and at least one of the holes is hemi-spherical.

9. The electrical connector of claim 1, wherein the inner side is non-planar comprising a series of platforms and a series of trenches arranged in a complementary pattern such that the platforms of one wafer sub-assembly are received in the trenches of the other wafer sub-assembly when the shells are mated together.

10. The electrical connector of claim 1, wherein each contact module comprises a first shield and a second shield, the first shield being coupled to a first of the wafer sub-assemblies, the second shield being coupled to a second of the wafer sub-assemblies.

11. The electrical connector of claim 10, wherein the first shield is mirrored with respect to the second shield about an interface between the wafer sub-assemblies.

12. The electrical connector of claim 1, wherein the shell includes shell lugs extending therefrom, the shell lugs engaging the housing to orient the contact module in the housing.

13. The electrical connector of claim 1, wherein the housing includes clip lugs extending therefrom, the shells including clip lugs extending therefrom, the electrical connector further comprising a bridge clip spanning from the housing to each of the shells of the contact modules, the bridge clip having openings receiving corresponding clip lugs of the housing or of the shells.

14. An electrical connector comprising:

a plurality of contact modules stacked parallel to each other within a housing, the housing and contact modules being configured to be mated with a mating connector at a mating end of the housing, the contact modules being configured to be mounted to a circuit board opposite the mating end;

each contact module comprising a pair of wafer sub-assemblies, the wafer sub-assemblies being identical and oriented 180° with respect to each other, each wafer sub-assembly comprising an overmolded leadframe and a conductive shell holding the overmolded leadframe;

the overmolded leadframe having a plurality of contacts including intermediate sections extending between mating ends and mounting ends, the mating ends being provided at the mating end of the housing for mating with the mating connector, the mounting ends being opposite the mating ends, the intermediate sections oriented generally linearly between the mating and mounting ends and being encased in an overmolded body of the overmolded leadframe; and the shell having a pocket at an inner side thereof receiving the overmolded leadframe, the inner side of the shell of one wafer sub-assembly facing the inner side of the shell of the other wafer sub-assembly, the shell of one wafer sub-assembly being secured to the shell of the other wafer sub-assembly, the shell providing electrical shielding for the contacts of the overmolded leadframe.

15. The electrical connector of claim 14, wherein the shell includes ribs extending into the pocket, the ribs being positioned between adjacent contacts to provide electrical shielding between the contacts.

16. The electrical connector of claim 14, wherein the shell of the one wafer sub-assembly is secured to the shell of the other wafer sub-assembly by hermaphroditic securing features.

17. The electrical connector of claim 14, wherein each contact module comprises a first shield and a second shield, the first shield being coupled to a first of the wafer sub-assemblies, the second shield being coupled to a second of the wafer sub-assemblies, the first shield being mirrored with respect to the second shield about an interface between the wafer sub-assemblies.

18. An electrical connector comprising:

a plurality of contact modules stacked parallel to each other within a housing, the housing and contact modules being configured to be mated with a mating connector at a mating end of the housing, each contact module comprising a first wafer sub-assembly and a second wafer sub-assembly, each contact module comprising a first shield coupled to the first wafer sub-assembly and a second shield coupled to the second wafer sub-assembly;

wherein the first and second wafer sub-assemblies are identical and oriented 180° with respect to each other, the first and second wafer sub-assemblies each comprising an overmolded leadframe and a conductive shell having a pocket at an inner side thereof holding the overmolded leadframe and providing electrical shielding for the overmolded leadframe, the overmolded leadframe having a plurality of contacts including intermediate sections extending between mating ends and mounting ends, the intermediate sections being encased in an overmolded body of the overmolded leadframe;

and wherein the first and second shields are coupled to the shells of the first and second wafer sub-assemblies, the first and second shields each including a main body with ground beams extending therefrom for mating with the mating connector.

19. The electrical connector of claim 18, wherein the shell includes ribs extending into the pocket, the ribs being positioned between adjacent contacts to provide electrical shielding between the contacts.

20. The electrical connector of claim 18, wherein each shell includes a plurality of securing features securing the shell of the first wafer sub-assembly to the shell of the second wafer sub-assembly, the securing features being hermaphroditic.

* * * * *